US008126173B2

(12) United States Patent
Wu et al.

(10) Patent No.: US 8,126,173 B2
(45) Date of Patent: Feb. 28, 2012

(54) SYSTEM AND METHOD FOR EXPANDING MULTI-SPEAKER PLAYBACK

(75) Inventors: Yuan Wu, Singapore (SG); Sapna George, Singapore (SG)

(73) Assignee: STMicroelectronics Asia Pacific Pte., Ltd., Singapore (SG)

( * ) Notice: Subject to any disclaimer, the term of this patent is extended or adjusted under 35 U.S.C. 154(b) by 1145 days.

(21) Appl. No.: 11/333,459

(22) Filed: Jan. 17, 2006

(65) Prior Publication Data

US 2006/0159190 A1 Jul. 20, 2006

(30) Foreign Application Priority Data

Jan. 20, 2005 (SG) ..... 200500302-5

(51) Int. Cl.
*H04R 5/02* (2006.01)

(52) U.S. Cl. ..... 381/307; 381/10; 381/27; 381/22

(58) Field of Classification Search ..... 381/80, 381/1, 61, 10, 12, 15, 17–23, 300–305, 307–310, 381/27, 28, 63, 97–98, 101–102, 103, 104, 381/119, 120; 700/94
See application file for complete search history.

(56) References Cited

U.S. PATENT DOCUMENTS 3,746,792 A * 7/1973 Scheiber ..... 381/23
3,885,099 A * 5/1975 Tsurushima et al. ..... 381/22
3,959,590 A 5/1976 Scheiber
4,799,260 A 1/1989 Mandell et al.
4,862,502 A 8/1989 Griesinger
5,172,415 A * 12/1992 Fosgate ..... 381/22
5,319,713 A 6/1994 Waller, Jr. et al.
5,428,687 A * 6/1995 Willcocks et al. ..... 381/18
5,666,424 A 9/1997 Fosgate et al.
5,666,640 A 9/1997 Daniylchev
5,825,320 A * 10/1998 Miyamori et al. ..... 341/139
6,198,826 B1 3/2001 Cowieson et al.
6,804,694 B2 * 10/2004 Albert et al. ..... 708/305
7,577,260 B1 * 8/2009 Hooley et al. ..... 381/77

OTHER PUBLICATIONS

"Dolby Surround Pro Logic II Decoder Principles of Operation", www.dolby.com/consumer/technologies/PLII/PLIIwhtppr.html.

* cited by examiner

*Primary Examiner* — Vivian Chin
*Assistant Examiner* — Leshui Zhang

(57) ABSTRACT

A method includes splitting and filtering a left input signal and a right input signal to produce a plurality of frequency sub-bands. Each of the frequency sub-bands includes a left sub-band signal and a right sub-band signal. The method also includes processing the left and right sub-band signals associated with each of the frequency sub-bands into a plurality of sub-band channel signals. The plurality of sub-band channel signals includes at least three sub-band channel signals. In addition, the method includes summing corresponding ones of the sub-band channel signals for reproduction in a corresponding channel of a plurality of channels. The plurality of sub-band channel signals may include a left sub-band channel signal, a right sub-band channel signal, a center sub-band channel signal, a left surround sub-band channel signal, and a right surround sub-band channel signal.

20 Claims, 8 Drawing Sheets

SYSTEM AND METHOD FOR EXPANDING MULTI-SPEAKER PLAYBACK

CROSS-REFERENCE TO RELATED APPLICATIONS

This application claims priority under 35 U.S.C. §119 to Singapore Patent Application No. 200500302-5 filed on Jan. 20, 2005, which is hereby incorporated by reference.

TECHNICAL FIELD

This disclosure relates generally to sound processing systems and more specifically to a system and method for expanding multi-speaker playback.

BACKGROUND

Multi-speaker systems are widely available in audio, video, and entertainment systems today. For example, quadratic four-speaker systems and 5.1 systems provide listeners with more enjoyable multi-media experiences compared to traditional stereo systems. However, there are large quantities of stereo audio content that are available and that are currently being produced. This stereo audio content does not fully utilize the advantages of multi-speaker systems such as quadratic four-speaker systems and 5.1 systems. There have been various difficulties in attempting to better utilize multi-speaker systems to give more listening pleasure when reproducing stereo audio content than straightforward stereo playback.

Many techniques have been developed to attempt to better render stereo audio content utilizing more than two speakers to create a surrounding sound field. Many of these techniques rely on the belief that in-phase information between two signals should be provided at the center front of a listener, while out-of-phase information should be provided to the rear of the listener.

Many of these techniques also suffer from various problems. These problems may include relatively high computational costs, an inability to efficiently handle input signals that have more than one dominant signal, or undesirable effects in the rendering of the stereo audio content (such as unnatural sound effects). Many conventional techniques cannot perform multi-speaker rendition of stereo audio content that achieves good channel separation with minimal and scalable computational costs, while being able to efficiently handle input signals having multiple dominant signals.

SUMMARY

This disclosure provides a system and method for expanding multi-speaker playback.

In a first embodiment, an apparatus includes a band-splitting filter bank for receiving, splitting, and filtering a left input signal and a right input signal into a plurality of frequency sub-bands. Each of the frequency sub-bands includes a left sub-band signal and a right sub-band signal. The apparatus also includes a plurality of synthesis structures each for receiving the left and right sub-band signals associated with one of the frequency sub-bands and for processing the received left and right sub-band signals into a plurality of sub-band channel signals. The plurality of sub-band channel signals includes at least three sub-band channel signals. Corresponding sub-band channel signals from the synthesis structures are summed and provided on an output channel.

In particular embodiments, the plurality of sub-band channel signals includes a left sub-band channel signal, a right sub-band channel signal, a center sub-band channel signal, a left surround sub-band channel signal, and a right surround sub-band channel signal.

In a second embodiment, a method includes splitting and filtering a left input signal and a right input signal to produce a plurality of frequency sub-bands. Each of the frequency sub-bands includes a left sub-band signal and a right sub-band signal. The method also includes processing the left and right sub-band signals associated with each of the frequency sub-bands into a plurality of sub-band channel signals. The plurality of sub-band channel signals includes at least three sub-band channel signals. In addition, the method includes summing corresponding ones of the sub-band channel signals for reproduction in a corresponding channel of a plurality of channels.

In a third embodiment, a system includes a plurality of input channels for receiving a left input signal and a right input signal. The system also includes a plurality of output channels for providing a plurality of output signals. The plurality of output signals includes at least three output signals. In addition, the system includes a channel synthesis processor for splitting the left input signal and the right input signal into a plurality of frequency sub-bands. Each of the frequency sub-bands includes a left sub-band signal and a right sub-band signal. The channel synthesis processor is also for processing the left and right sub-band signals associated with each of the frequency sub-bands into a plurality of sub-band channel signals. In addition, the channel synthesis processor is for summing corresponding ones of the sub-band channel signals to produce the plurality of output signals.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
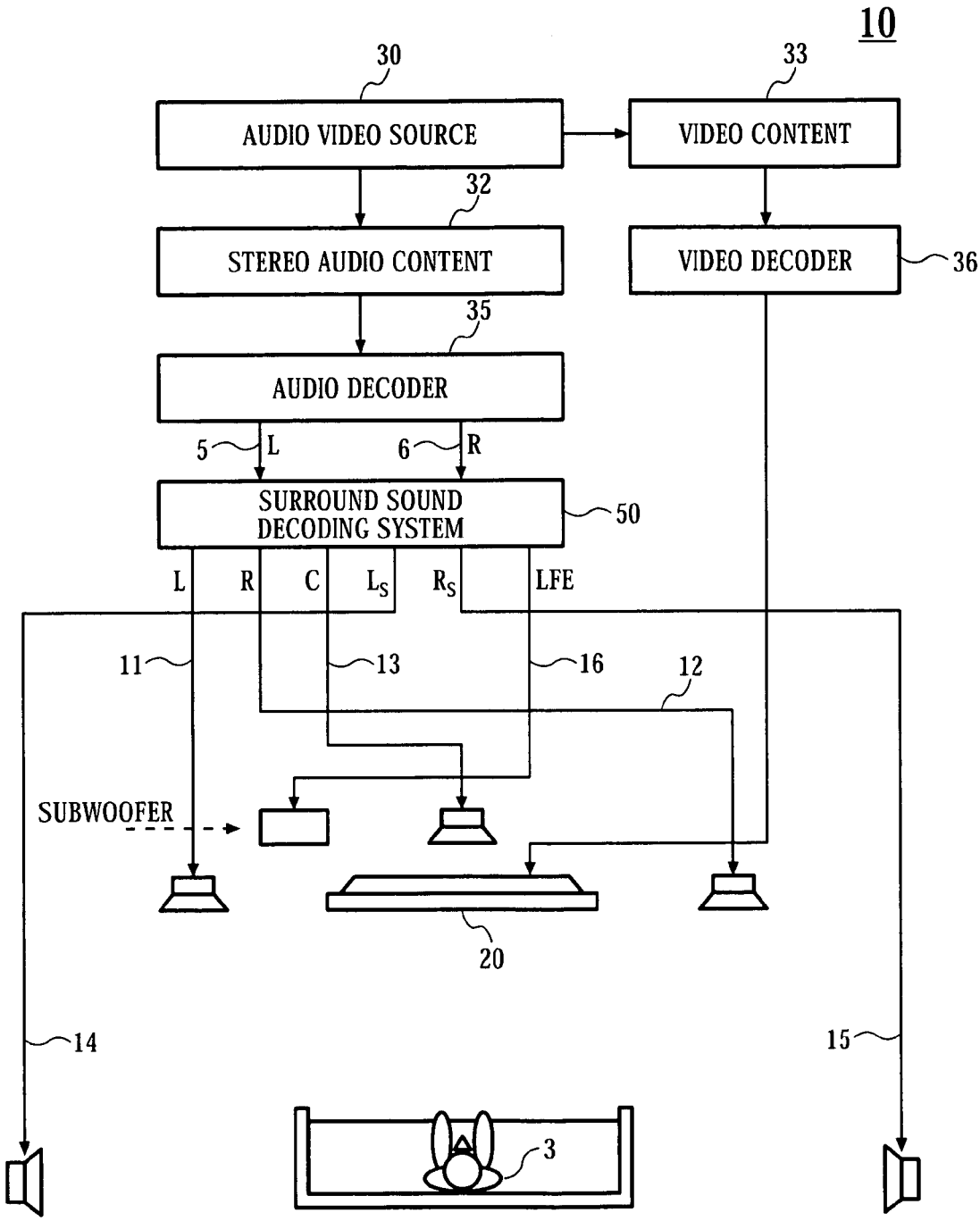
FIG. 1 illustrates a multi-speaker system according to one embodiment of this disclosure.

FIGS. 1 through 8, discussed below, and the various embodiments described in this disclosure are by way of illustration only and should not be construed in any way to limit the scope of the claimed invention. Those skilled in the art will understand that the principles described in this disclosure may be implemented in any suitably arranged device or system.

In the following description, a system is provided for reproducing stereo sounds, while providing for improved channel separation and handling one or more dominant signals. The system also addresses the issue of scalability in terms of computation and memory usage. While described as being implemented in a 5.1 speaker system, the same or similar techniques could be used in any suitable multi-speaker system.

In some embodiments, the system uses multi-band processing to allow different frequency bands to be steered separately. This may provide better channel separation when there is more than one dominant signal. As the number of frequency bands increases, the ambiguity of decoding may be reduced as the chances of a dominant band falling into the different frequency bands increases.

Moreover, in some embodiments, the problems associated with multiple dominant signals are further decreased by introducing a slow decay of surround signals when there is a dominant center signal or a slow decay of center signals when there is a dominant surround signal. This may be based on the assumption that not all dominant signals are active at all times. For example, a dominant signal at a center channel with dialog may have pauses between words and sentences. If a dominant signal is present in the center channel, surround channels may not be completely muted within a short period of time. Rather, a slow decay may be used, which may enable faster recovery during the inactive time of the center channel.

The following represents a conventional stereo encoding:

$$Lt=L+0.707C-0.707S$$

$$Rt=R+0.707C+0.707S$$

where Lt and Rt represent the left and right channels after encoding, and L, R, C, and S represent the left, right, center, and surround channels, respectively. The phase of the surround channel is normally shifted by 90 degree before encoding. The decoding process may take a matrix, such as:

$$\begin{bmatrix} L \\ R \\ C \\ S \end{bmatrix} = \begin{bmatrix} G_{LL} & G_{LR} \\ G_{RL} & G_{RR} \\ G_{CL} & G_{CR} \\ G_{SL} & G_{SR} \end{bmatrix} \times \begin{bmatrix} Lt \\ Rt \end{bmatrix}$$

where G represents the gain. Many decoders implement a decoding technique expressed by:

$$L=G_L \times Lt$$

$$R=G_R \times Rt$$

$$C=G_C \times (Rt+Lt)$$

$$S=G_s \times (Rt-Lt)$$

where $G_L$, $G_R$, $G_c$, and $G_s$ represent the gains for the left, right, center, and surround channels, respectively.

These gains are often obtained by analyzing the in-phase and out-of-phase signals between the two inputs (Lt and Rt). Mathematically, it may not be possible to reproduce the exact original multi-channel audio content once the content has been mixed into stereo content. Rather, an approximation of the original audio signals may be derived based on certain assumptions. The most common assumption may be that there is only one dominant audio signal at any given time, which is often not true. If there is actually more than one dominant signal at a particular time, this assumption may lead to incorrect decoding. For example, if there exists a dominant center signal and a dominant surround signal at the same time, many decoders may, instead of outputting a center signal and a surround signal, output a left signal and a right signal.

The system of this disclosure splits input signals into a number of frequency sub-bands. Each frequency sub-band is then processed by a synthesis structure. In some embodiments, the same synthesis structure can be reused by all of the frequency sub-bands. By summing the outputs from the synthesis structures for all of the sub-bands, a multi-channel output may be provided for output by the speaker system.

In some embodiments, in the synthesis structure, the left and right outputs are obtained using the left and right inputs with a gain. The center output is obtained using the sum of the left and right inputs with a gain. The surround outputs are obtained using the difference between the right and left inputs with a gain. Gains are further applied to the two surround outputs to steer the surround information between left surround and right surround. In particular embodiments, the synthesis structure may contain signal detection and feedback mechanisms to control all of these gains. Also, the gain of each frequency sub-band for each output may be regulated through gradual increments and decrements to avoid rapid fluctuations.

FIG. 1 illustrates a multi-speaker system 10 according to one embodiment of this disclosure. The embodiment of the multi-speaker system 10 shown in FIG. 1 is for illustration only. Other embodiments of the multi-speaker system 10 may be used without departing from the scope of this disclosure.

In this example, an audio video source 30 is split into its audio content 32 and its video content 33. The audio content 32 is provided to an audio decoder 35, and the video content 33 is provided to a video decoder 36. The output from the video decoder 36 is provided to a display unit 20 for presentation of visual images. The output from the audio decoder 35 (which includes a left input signal 5 and a right input signal 6 from decoded stereo audio content) is provided to a surround sound decoding system (SSDS) 50.

The SSDS 50 processes the left and right input signals 5-6 and produces a plurality of channels, each for playing on a respective speaker in the multi-speaker system 10. A listener 3 sitting at an optimum location may be able to enjoy the stereo audio content played through such a multi-speaker system 10. In this example, the plurality of channels that may be played by the respective speakers are a left channel 11, a right channel 12, a center channel 13, a left surround channel 14, a right surround channel 15, and a low frequency effects (LFE) channel 16 (i.e. a subwoofer).

Figure 2:
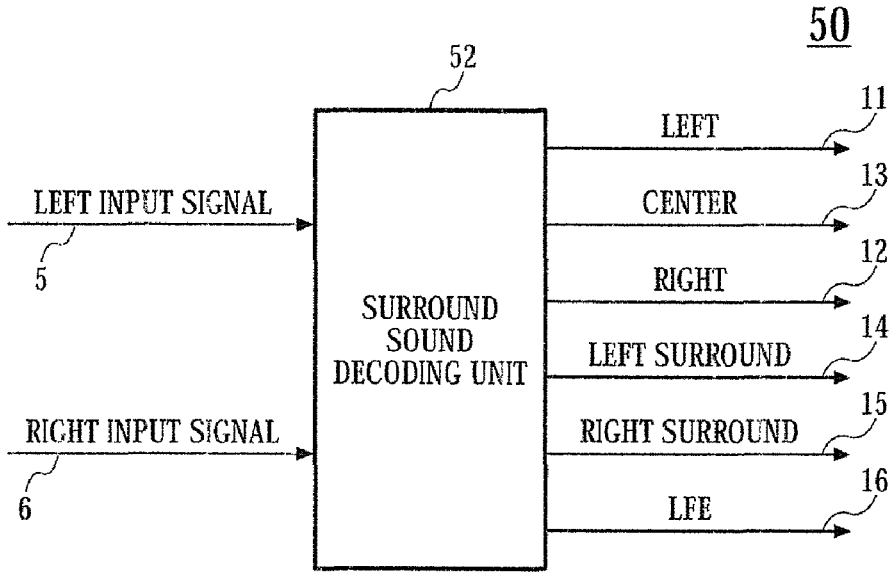
FIG. 2 illustrates a surround sound decoding system in the multi-speaker system of FIG. 1 according to one embodiment of this disclosure.

FIG. 2 illustrates a surround sound decoding system (SSDS) 50 in the multi-speaker system 10 of FIG. 1 according to one embodiment of this disclosure. The embodiment of the SSDS 50 shown in FIG. 2 is for illustration only. Other embodiments of the SSDS 50 may be used without departing from the scope of this disclosure.

As shown in FIG. 2, the SSDS 50 includes a surround sound decoding unit (SSDU) 52. The SSDU 52 receives the left input signal 5 and the right input signal 6 and produces the plurality of channels. In this example, the plurality of channels includes the left channel 11, the right channel 12, the center channel 13, the left surround channel 14, the right surround channel 15, and the low frequency effects channel 16.

Figure 3:
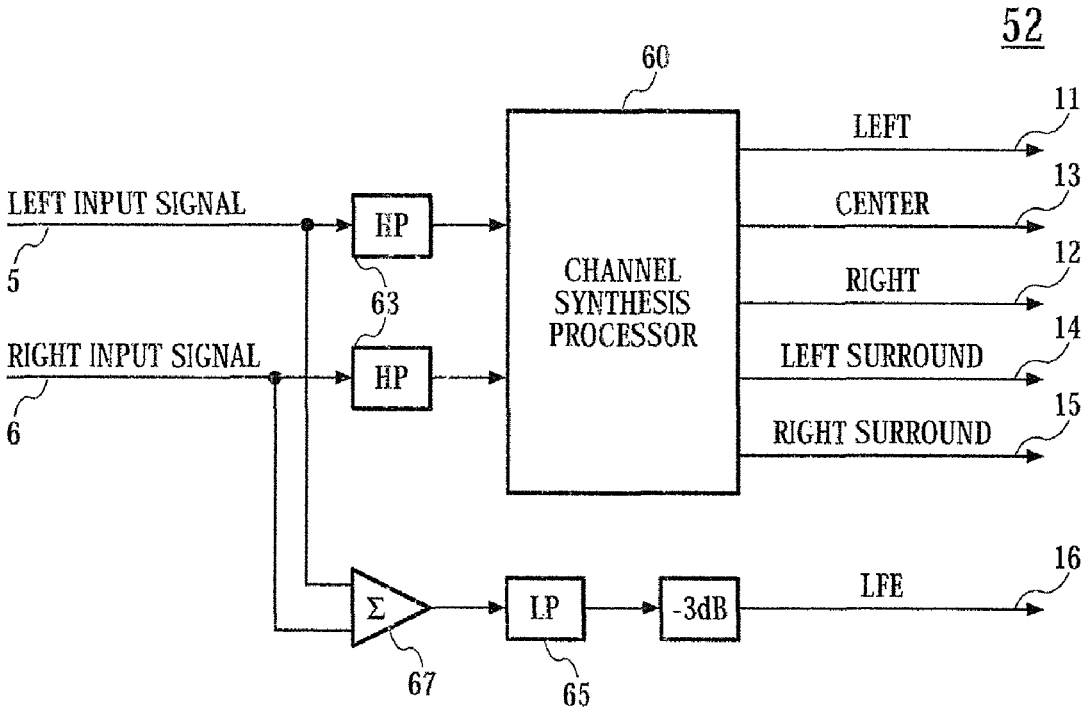
FIG. 3 illustrates a surround sound decoding unit in the surround sound decoding system of FIG. 2 according to one embodiment of this disclosure.

FIG. 3 illustrates a surround sound decoding unit (SSDU) 52 in the surround sound decoding system 50 of FIG. 2 according to one embodiment of this disclosure. The embodiment of the SSDU 52 shown in FIG. 3 is for illustration only. Other embodiments of the SSDU 52 may be used without departing from the scope of this disclosure.

In this example, the SSDU 52 includes a channel synthesis processor 60, which receives the left input signal 5 and the right input signal 6 via a pair of high pass filters 63. The left input signal 5 and the right input signal 6 are also summed in a mixer 67 before filtering in a low pass filter 65 to produce the low frequency effects. In particular embodiments, a cutoff frequency could vary from 50 Hz to 200 Hz, depending on the speaker and subwoofer characteristics. An attenuation, such as an attenuation of 3 dB, may be performed to normalize the loudness of the LFE channel 16.

Figure 4:
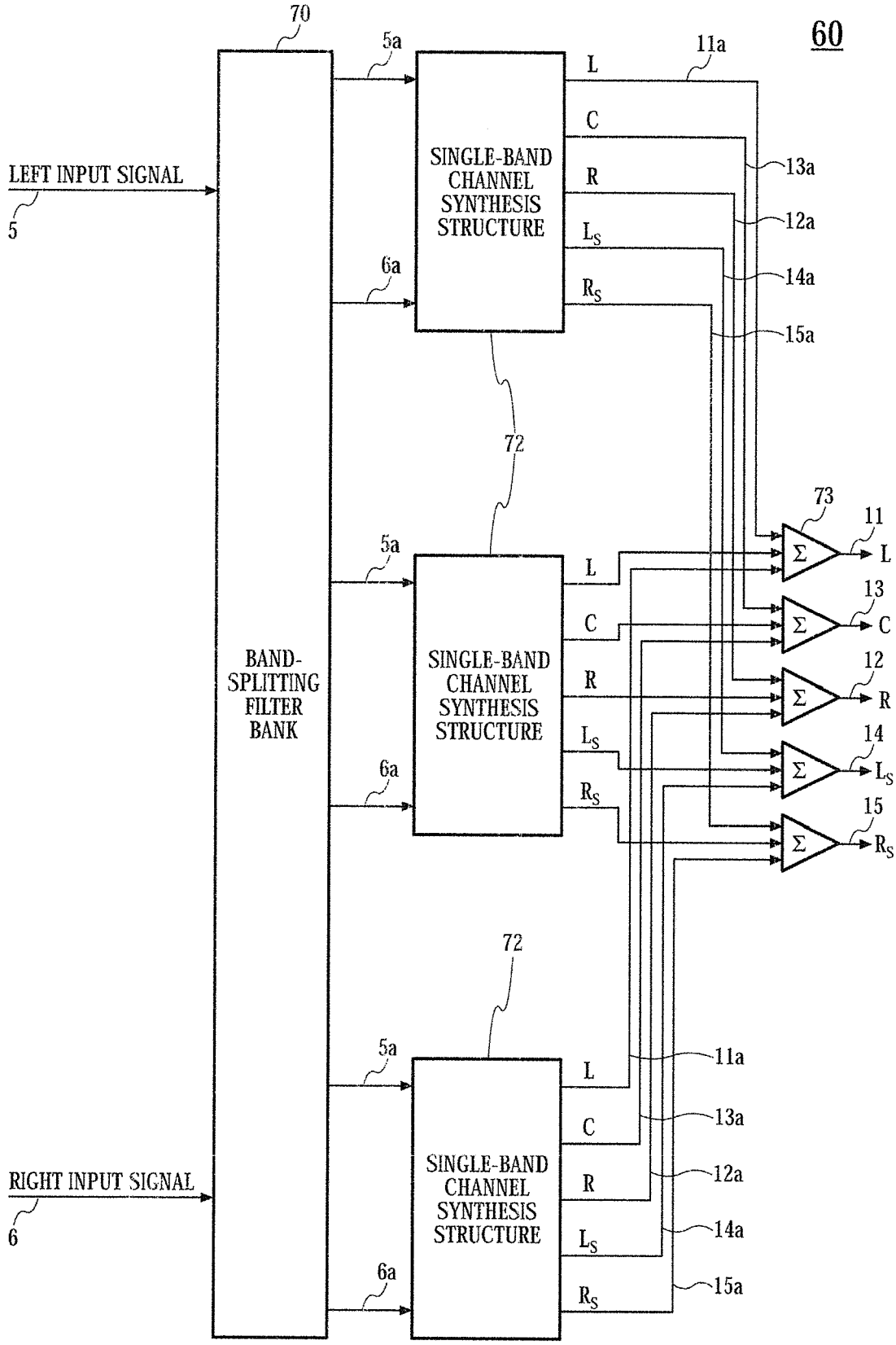
FIG. 4 illustrates a channel synthesis processor in the surround sound decoding unit of FIG. 3 according to one embodiment of this disclosure.

FIG. 4 illustrates a channel synthesis processor 60 in the surround sound decoding unit 52 of FIG. 3 according to one embodiment of this disclosure. The embodiment of the channel synthesis processor 60 shown in FIG. 4 is for illustration only. Other embodiments of the channel synthesis processor 60 may be used without departing from the scope of this disclosure.

In this example, the channel synthesis processor 60 includes a band-splitting filter bank 70. The band-splitting filter bank 70 receives the left input signal 5 and the right input signal 6 for splitting and filtering to generate a plurality of frequency sub-bands. Each of the frequency sub-bands includes a left sub-band signal 5*a* and a right sub-band signal 6*a*. The number of frequency sub-bands could vary depending on the processing or computational power allocated or available in the channel synthesis processor 60. In general, the quality of the audio reproduction may be higher when more frequency sub-bands are used in the system.

The left sub-band signal 5*a* and the right sub-band signal 6*a* of each frequency sub-band are processed by a single-band channel synthesis structure 72, which produces a plurality of sub-band channel signals. The sub-band channel signals in this embodiment include a left sub-band channel signal 11*a*, a right sub-band channel signal 12*a*, a center sub-band channel signal 13*a*, a left surround sub-band channel signal 14*a*, and a right surround sub-band channel signal 15*a*. The corresponding sub-band channel signals from the single-band channel synthesis structures 72 are summed in mixers 73, and each sum is sent to its respective output channel to be reproduced by the appropriate speaker.

In some embodiments, each of the single-band channel synthesis structures 72 is controlled by specified or predetermined control parameters. The process of splitting the input signals 5-6 into a plurality of frequency sub-bands and processing each frequency sub-band to produce a plurality of sub-band channel signals 11*a*-15*a* may be referred to as band based steering. Band based steering may be used to achieve better channel separation, and it may provide easy scalability by scaling the number of frequency sub-bands.

Figure 5:
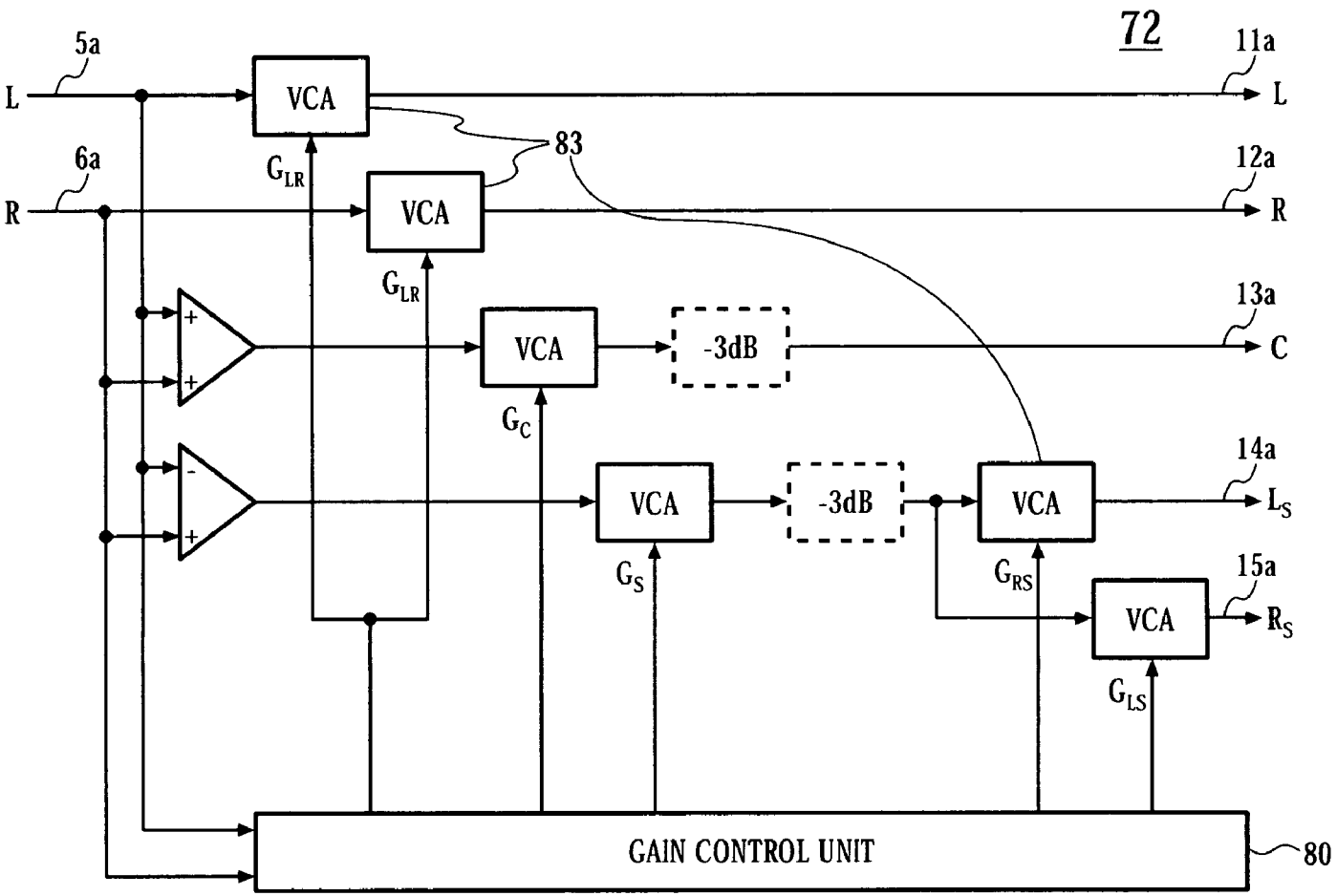
FIG. 5 illustrates a single-band channel synthesis structure in the channel synthesis processor of FIG. 4 according to one embodiment of this disclosure.

FIG. 5 illustrates a single-band channel synthesis structure 72 in the channel synthesis processor 60 of FIG. 4 according to one embodiment of this disclosure. The embodiment of the single-band channel synthesis structure 72 shown in FIG. 5 is for illustration only. Other embodiments of the single-band channel synthesis structure 72 may be used without departing from the scope of this disclosure.

In this example, the single-band channel synthesis structure 72 receives a left sub-band signal 5*a* and a right sub-band signal 6*a* of a frequency sub-band. The single-band channel synthesis structure 72 processes the sub-band signals 5*a*-6*a* and produces the left sub-band channel signal 11*a*, the right sub-band channel signal 12*a*, the center sub-band channel signal 13*a*, the left surround sub-band channel signal 14*a*, and the right surround sub-band channel signal 15*a*.

In this embodiment, the sub-band channel signals 11*a*-15*a* are generated by voltage-controlled amplifiers (VCAs) 83. The VCAs 83 amplify the left sub-band signal 5*a*, the right sub-band signal 6*a*, and other signals based on the sub-band signals 5*a*-6*a* with a plurality of specified or predetermined gains from a gain control unit 80. More specifically, the left sub-band channel signal 11*a* may be generated using the left sub-band signal 5*a* and a left right gain $G_{LR}$. The right sub-band channel signal 12*a* may be generated using the right sub-band signal 6*a* and the left right gain $G_{LR}$.

The center sub-band channel signal 13*a* may be generated using a sum of the left sub-band signal 5*a* and the right sub-band signal 6*a*, amplified with a center gain $G_C$. The resulting signal can further be attenuated, such as by 3 dB, before being output for consolidation by the appropriate mixer 73.

The left surround sub-band channel signal 14*a* may be generated using a difference between the left sub-band signal 5*a* and the right sub-band signal 6*a*, amplified with a surround gain $G_S$ and further amplified using a right surround gain $G_{RS}$. The signal may be attenuated, such as by 3 dB, before being amplified by the right surround gain $G_{RS}$. Similarly, the right surround sub-band channel signal 15*a* may be generated using the difference between the left sub-band signal 5*a* and the right sub-band signal 6*a*, amplified with the surround gain $G_S$ and further amplified using a left surround gain $G_{LS}$. The signal may be attenuated, such as by 3 dB, before being amplified by the left surround gain $G_{LS}$.

The attenuation of some of the signals may be done to normalize the amplitudes of the signals. This may be needed, for example, due to the summing of the left sub-band signal 5*a* and the right sub-band signal 6*a*.

The gains from the gain control unit 80 may be generated in any suitable manner. For example, the gains could be generated using calculations performed on the left sub-band signal 5*a* and the right sub-band signal 6*a*.

Figure 6:
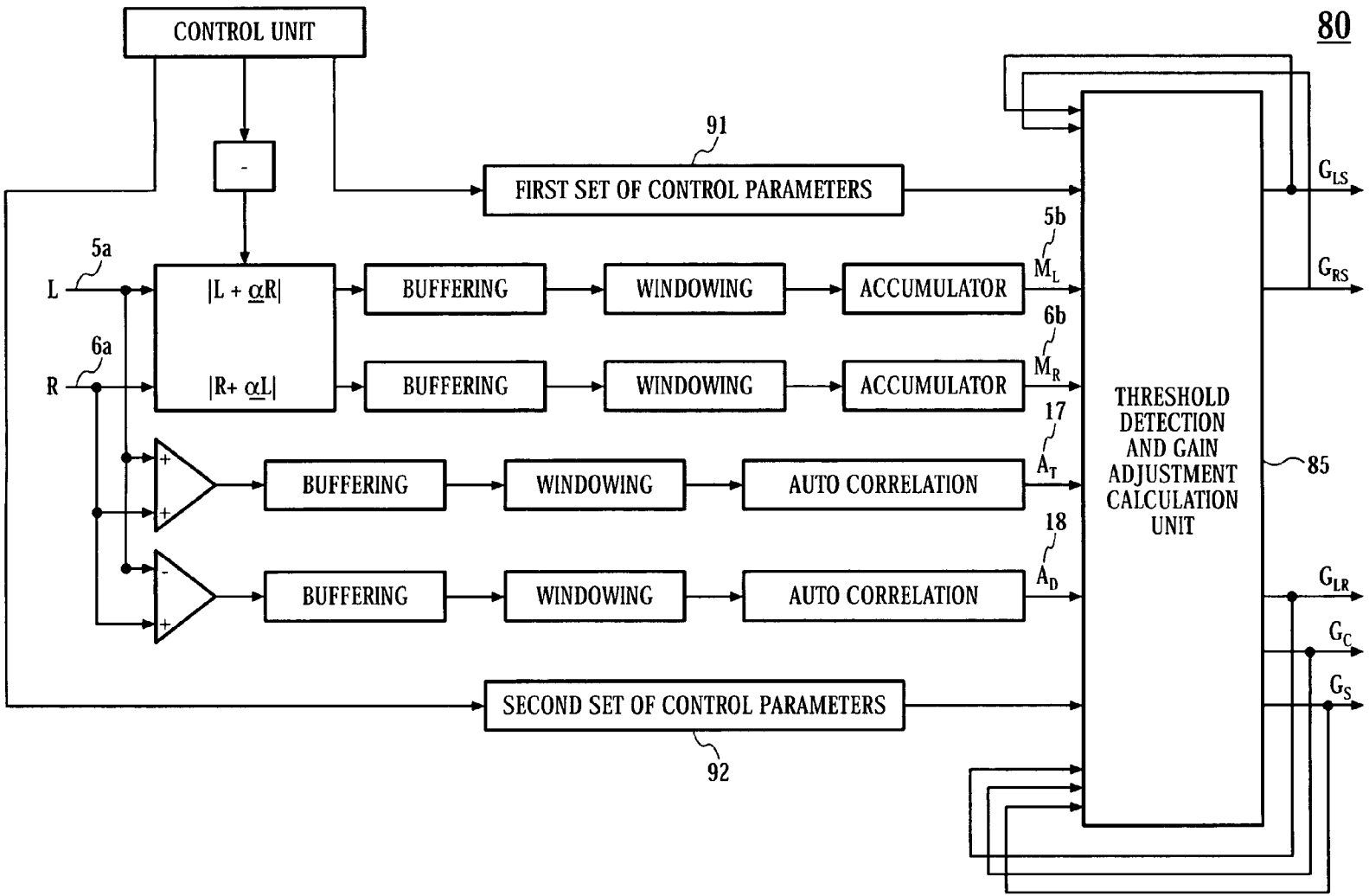
FIG. 6 illustrates a gain control unit in the single-band channel synthesis structure of FIG. 5 according to one embodiment of this disclosure.

FIG. 6 illustrates a gain control unit 80 in the single-band channel synthesis structure 72 of FIG. 5 according to one embodiment of this disclosure. The embodiment of the gain control unit 80 shown in FIG. 6 is for illustration only. Other embodiments of the gain control unit 80 may be used without departing from the scope of this disclosure.

In this example, the gains may be generated by a threshold detection and gain adjustment calculation (TDGC) unit 85. For calculating the $G_{LS}$ and $G_{RS}$ gains, the left sub-band signal 5*a* and the right sub-band signal 6*a* are buffered using an initial buffer having a predetermined or specified algorithm. The signals 5*a*-6*a* may be further buffered using buffer lengths that could vary (such as between 5 ms to 0.1 s). The buffered signals are then windowed, such as by using any of a plurality of specified or predetermined windows. In some embodiments, rectangular windows may be used for low computational power uses, or more complicated windows (such as hamming windows) may be used if computational power is not an issue. The buffered and windowed signals are then accumulated and sent to the TDGC unit 85. The signals sent to the TDGC unit 85 are a left accumulation value $M_L$ 5*b* and a right accumulation value $M_R$ 6*b*.

The left accumulation value $M_L$ 5*b* and the right accumulation value $M_R$ 6*b* may undergo a threshold detection and gain adjustment calculation process in the TDGC unit 85 to generate the gains $G_{LS}$ and $G_{RS}$. These gains $G_{LS}$ and $G_{RS}$ may be generated using a first set of control parameters 91 in a control unit. The first set of control parameters 91 may include at least an increment and/or decrement size D.

In particular embodiments, the initial buffer used for buffering the left sub-band signal 5*a* may be represented by $|L+\alpha R|$ for the left accumulation value $M_L$ 5*b*, and the initial buffer used for buffering the right sub-band signal 6*a* may be represented by $|R+\alpha L|$ for the right accumulation value $M_R$ 6*b*. In these embodiments, $\alpha$ represents a control parameter, such as a parameter varying from 0.0 to 0.4.

For calculating the $G_{LR}$, $G_C$, and $G_S$ gains, the left sub-band signal 5*a* and the right sub-band signal 6*a* are used to generate a total correlation value $A_T$ 17 and a differential correlation value $A_D$ 18. The total correlation value $A_T$ 17 and the differential correlation value $A_D$ 18 are sent to the TDGC unit 85. These, together with a second set of control parameters 92 from the control unit, are used in the TDGC unit 85 to calculate the $G_{LR}$, $G_C$, and $G_S$ gains.

For generating the total correlation value $A_T$ 17, the left sub-band signal 5*a* and the right sub-band signal 6*a* may be summed before undergoing buffering. The buffering may be done with variable buffer lengths (such as lengths varying between 5 ms to 0.1 s). The buffered signals are then windowed using any predetermined or specified window. In some embodiments, rectangular windows may be used for low computational power uses, and more complicated hamming or other windows may be applied if computational power is not an issue. The summed, buffered, and windowed signals may then be auto-correlated to generate the total correlation value $A_T$ 17.

For generating the differential correlation value $A_D$ 18, the left sub-band signal 5*a* is subtracted from the right sub-band signal 6*a*. The difference is then buffered and windowed in a similar manner before undergoing auto-correlation to generate the differential correlation value $A_D$ 18.

Figure 7A:
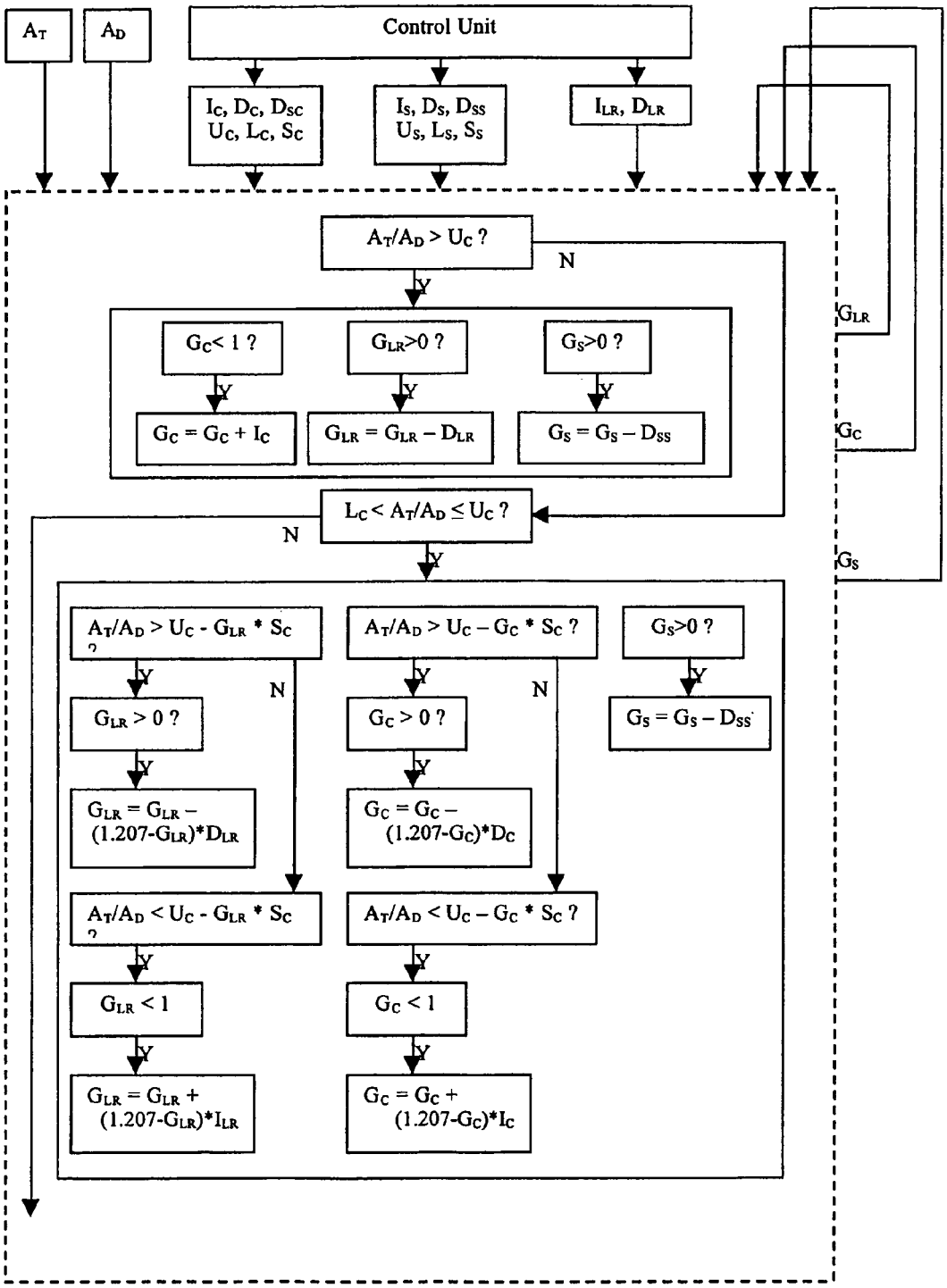
FIGS. 7A, 7B, and 8 illustrate methods for determining gains in a surround sound decoding system according to one embodiment of this disclosure.
Figure 7B:
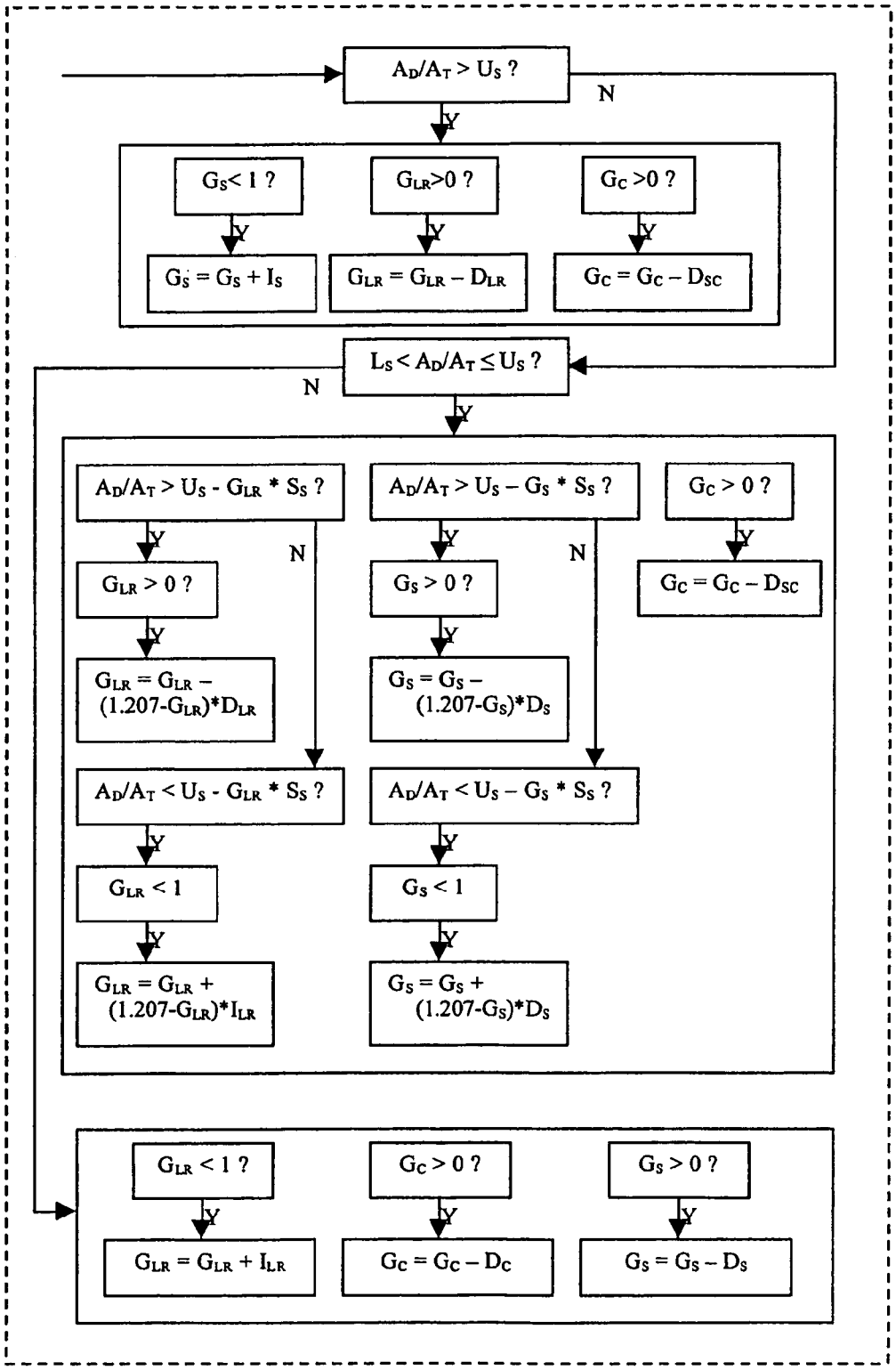
Figure 8:
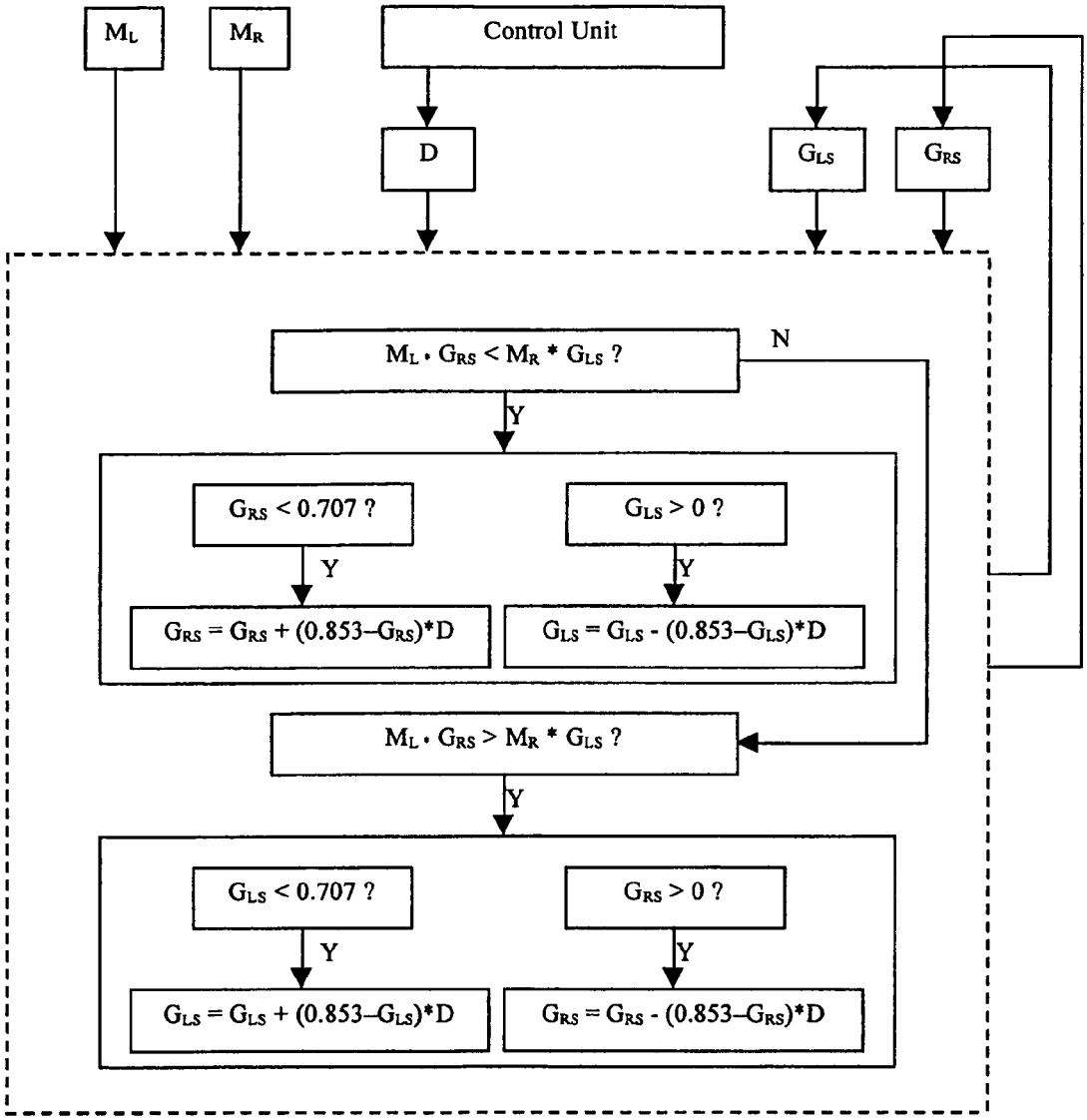

FIGS. 7A, 7B, and 8 illustrate methods for determining gains in a surround sound decoding system according to one embodiment of this disclosure. The methods shown in FIGS. 7A, 7B, and 8 are for illustration only. Other methods for determining gains in a surround sound decoding system could be used without departing from the scope of this disclosure.

FIGS. 7A and 7B illustrate detailed calculations for determining the gains $G_{LR}$, $G_C$, and $G_S$. A gain value is gradually increased to a maximum when there is a presence of a strong dominant signal. If there is no clear dominant signal, ideal gain values are calculated, and the gain values are gradually moved towards the ideal gain values. Slower decay may be introduced for a surround channel signal when there is a strong center channel signal, and vice versa.

In some embodiments, the second set of control parameters 92 includes:

- $I_C$: value of increment for the center channel
- $D_C$: value of decrement for the center channel
- $D_{SC}$: value of decrement for the center channel with slow decay (such as 2-5 times smaller than $D_C$)
- $U_C$: upper threshold value for center channel
- $L_C$: lower threshold value for center channel
- $S_C$: difference between the upper and lower threshold values for center channel
- $I_S$: value of increment for the surround channel
- $D_S$: value of decrement for the surround channel
- $D_{SS}$: value of decrement for the surround channel with slow decay (such as 2-5 times smaller than $D_S$)
- $U_S$: upper threshold value for surround channel
- $L_S$: lower threshold value for surround channel
- $S_S$: difference between the upper and lower threshold values for surround channel
- $I_{LR}$: value of increment for the left and right channels
- $D_{LR}$: value of decrement for the left and right channels The logic flow in FIGS. 7A and 7B determines the next gain value by taking the current gain values and adjusting them after analyzing the output from the auto-correlators ($A_T$ 17 and $A_D$ 18).

Referring to FIGS. 7A and 7B, the logic flow of the calculations are as follows:

| | |
|---|---|
| If $A_T/A_D > U_C$ | Condition 1 |
| If $G_C < 1$ | |
| $G_C = G_C + I_C$ | |
| End | |
| If $G_{LR} > 0$ | |
| $G_{LR} = G_{LR} - D_{LR}$ | |
| End | |
| If $G_S > 0$ | |
| $G_S = G_S - D_{SS}$ | |
| End | |
| Else if $L_C < A_T/A_D \leqq U_C$ | Condition 2 |
| If $A_T/A_D > U_C - G_{LR}*S_C$ | Condition 2a |
| If $G_{LR} > 0$ | |
| $G_{LR} = G_{LR} - (1.207 - G_{LR})*D_{LR}$ | Eqn. 2.1 |
| End | |
| Else if $A_T/A_D < U_C - G_{LR}*S_C$ | Condition 2b |
| If $G_{LR} < 1$ | |
| $G_{LR} = G_{LR} + (1.207 - G_{LR})*I_{LR}$ | Eqn. 2.2 |
| End | |
| End | |
| If $A_T/A_D > U_C - G_C * S_C$ | Condition 2c |
| If $G_C > 0$ | |
| $G_C = G_C - (1.207 - G_C)*D_C$ | Eqn. 2.3 |
| End | |
| Else if $A_T/A_D < U_C - G_C*S_C$ | Condition 2d |
| If $G_C < 1$ | |
| $G_C = G_C + (1.207 - G_C)*I_C$ | Eqn. 2.4 |
| End | |
| End | |
| If $G_S > 0$ | |
| $G_S = G_S - D_{SS}$ | |
| End | |
| Else if $A_D/A_T > U_S$ | Condition 3 |
| If $G_S < 1$ | |
| $G_S = G_S + I_S$ | |
| End | |
| If $G_{LR} > 0$ | |
| $G_{LR} = G_{LR} - D_{LR}$ | |
| End | |
| If $G_C > 0$ | |
| $G_C = G_C - D_{SC}$ | |
| End | |
| Else if $L_S < A_D/A_T \leqq U_S$ | Condition 4 |
| If $A_D/A_T > U_S - G_{LR} * S_S$ | Condition 4a |
| If $G_{LR} > 0$ | |
| $G_{LR} = G_{LR} - (1.207 - G_{LR})*D_{LR}$ | Eqn. 4.1 |
| End | |
| Else if $A_D/A_T < U_S - G_{LR}*S_S$ | Condition 4b |
| If $G_{LR} < 1$ | |
| $G_{LR} = G_{LR} + (1.207 - G_{LR})*I_{LR}$ | Eqn. 4.2 |
| End | |
| End | |
| If $A_D/A_T > U_S - G_S* S_S$ | Condition 4c |
| If $G_S > 0$ | |
| $G_S = G_S - (1.207 - G_S)*D_S$ | Eqn. 4.3 |
| End | |
| Else if $A_D/A_T < U_S - G_S * S_S$ | Condition 4d |
| If $G_S < 1$ | |
| $G_S = G_S + (1.207 - G_S)*D_S$ | Eqn. 4.4 |
| End | |
| End | |
| If $G_C > 0$ | |
| $G_C = G_C - D_{SC}$ | |
| End | |
| Else | |
| If $G_{LR} < 1$ | |
| $G_{LR} = G_{LR} + I_{LR}$ | |
| End | |
| If $G_C > 0$ | |
| $G_C = G_C - D_C$ | |
| End | |

-continued

```
        If G_S > 0
            G_S = G_S − D_S
        End
    End
```

The following represents a summary of the logic flow for calculating the gains $G_{LR}$, $G_C$, and $G_S$ in FIGS. 7A and 7B. When one sub-band channel signal is dominant, the gain for that sub-band channel signal is incremented, while the other two gains are decremented. When the correlation factor ratio $A_T/A_D$ is greater than $U_C$ (Condition 1), the center sub-band channel signal 13*a* is dominant, and $G_C$ is incremented while $G_{LR}$ and $G_S$ are decremented.

When the correlation factor ratio $A_T/A_D$ is between $L_C$ and $U_C$ (Condition 2), the left sub-band channel signal 11*a*, the right sub-band channel signal 12*a*, and the center sub-band channel signal 13*a* are exhibiting dominant characteristics. $G_{LR}$ is then compared with an ideal $G_{LR}$ value (Conditions 2a, 2b) and decremented (Eqn. 2.1) or incremented (Eqn. 2.2) towards that ideal value. $G_C$ is also compared with an ideal $G_C$ value (Conditions 2c, 2d) and decremented (Eqn. 2.3) or incremented (Eqn. 2.4) towards that ideal value. In addition, $G_S$ may be decremented.

When the correlation factor ratio $A_T/A_D$ is less than $U_S$ (Condition 3), the left surround sub-band channel signal 14*a* and the right surround sub-band channel signal 15*a* are dominant. $G_S$ is incremented while $G_{LR}$ and $G_C$ are decremented.

When the correlation factor ratio $A_T/A_D$ is between $L_S$ and $U_S$ (Condition 4), the left sub-band channel signal 11*a*, the right sub-band channel signal 12*a*, the left surround sub-band channel signal 14*a*, and the right surround sub-band channel signal 15*a* are exhibiting dominant characteristics. $G_{LR}$ is compared with an ideal $G_{LR}$ value (Conditions 4a, 4b) and decremented (Eqn. 4.1) or incremented (Eqn. 4.2) towards that ideal value. $G_S$ is also compared with an ideal $G_S$ value (Conditions 4c, 4d) and decremented (Eqn. 4.3) or incremented (Eqn. 4.4) towards that ideal value. In addition, $G_C$ may be decremented.

When the left sub-band channel signal 11*a* and the right sub-band channel signal 12*a* are dominant, $G_{LR}$ is incremented while $G_C$ and $G_S$ are decremented.

FIG. 8 illustrates detailed calculations for determining the gains $G_{LS}$ and $G_{RS}$. The left accumulation value $M_L$ 5*b* and the right accumulation value $M_R$ 6*b* are used in conjunction with the first set of control parameters 91, which includes the predetermined or specified increment and/or decrement size D.

In general, each of these gains is assigned with specified or predetermined increment and decrement step sizes. When a single dominant signal is detected at an input channel, the corresponding gain is incremented until a maximum value, and other gains are decremented until minimum values. When more than one dominant signal is present, the gains of each output are incremented or decremented towards ideal values. Furthermore, when a dominant center signal is detected, the gain of the surround channel is decremented at a smaller step, and vice versa.

Referring to FIG. 8, the logic flow of the calculations are as follows:

```
If M_L * G_RS < M_R * G_LS                          Condition 5
    If G_RS < 0.707
        G_RS = G_RS + (0.853 − G_RS)*D              Eqn. 5.1
    End
    If G_LS > 0
        G_LS = G_LS − (0.853 − G_LS)*D              Eqn. 5.2
    End
Else if M_L * G_RS > M_R * G_LS                     Condition 6
    If G_LS < 0.707
        G_LS = G_LS + (0.853 − G_LS)*D              Eqn. 6.1
    End
    If G_RS > 0
        G_RS = G_RS − (0.853 − G_RS)*D              Eqn. 6.2
    End
End
```

The following represents a summary of the logic flow for calculating the gains $G_{LS}$ and $G_{RS}$ in FIG. 8. An accumulation value ratio $M_R/M_L$ is compared with a ratio of $G_{RS}$ and $G_{LS}$. When the accumulation value ratio $M_R/M_L$ is greater than the ratio of $G_{RS}$ and $G_{LS}$ (Condition 5), $G_{RS}$ is incremented (Eqn. 5.1) while $G_{LS}$ is decremented (Eqn. 5.2). When the accumulation value ratio $M_R/M_L$ is less than the ratio of $G_{RS}$ and $G_{LS}$ (Condition 6), $G_{RS}$ is decremented (Eqn. 6.1) while $G_{LS}$ is incremented (Eqn. 6.2).

The above description has described a system and method for reproducing stereo audio content on up to five speakers and a sub-woofer in a 5.1 speaker system. Channel separation is enhanced by separately processing frequency sub-bands. Any sudden volume changes in the output channels may be tempered using gradual increments and decrements in the gain value of each channel. Transitions from one channel to another may also be made smooth with slow decays in the gain value of each channel. This system and method may be fully scalable to meet the computational constraints of the hardware used. Further, in some embodiments, all sub-band processing shares the same structure, saving hardware size or code size (depending on how the algorithm is realized). In addition, the computational power required may be relatively small compared with prior techniques that employ complex logarithmic computations using digital signal processors.

While a system has been described above as being formed from various components, any component described in this document could be implemented in any hardware, software, firmware, or combination thereof. In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The terms "controller" and "processor" mean any device, system, or part thereof that controls or performs at least one operation. A controller or processor may be implemented in hardware, firmware, software, or some combination of at least two of the same. The functionality associated with any particular controller or processor may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus, comprising:

a band-splitting filter bank configured to receive, split, and filter a left input signal and a fight input signal into a plurality of frequency sub-bands, each of the frequency sub-bands comprising a left sub-band signal and a fight sub-band signal;

a plurality of synthesis structures, each synthesis structure comprising a gain control unit and configured to receive the left and right sub-band signals associated with one of the frequency sub-bands and to process the received left and right sub-band signals into a plurality of sub-band channel signals, wherein the gain control unit is configured to calculate a plurality of frequency sub-band specific gain values for each of the sub-band channel signals using predetermined windows, each frequency sub-band specific gain value for one of the sub-band channel signals adjusted between a maximum gain and an ideal gain based upon a presence of a dominant signal in the sub-band channel signals, wherein the plurality of sub-band channel signals comprises: a plurality of left sub-band channel signals, a plurality of right sub-band channel signals, a plurality of center sub-band channel signals, a plurality of left surround sub-band channel signals, and a plurality of right surround sub-band channel signals; and a mixer configured to sum a corresponding plurality of sub-band channel signals received from an output of the synthesis structures into a respective left channel, right channel, center channel, left surround channel, and right surround channel.

2. The apparatus of claim 1, wherein, the left and right input signals are high pass filtered before processing by the synthesis structures, and the left and right input signals are summed and low pass filtered to produce a low frequency effects channel.

3. The apparatus of claim 1, wherein each of the synthesis structures further comprises:

a plurality of amplifiers configured to amplify signals using the gain values.

4. The apparatus of claim 3, wherein the plurality of amplifiers comprises:

a first amplifier configured to amplify the left sub-band signal with a first of the gain values to produce the left sub-band channel signals; and a second amplifier configured to amplify the right sub-band signal with the first of the gain values to produce the right sub-band channel signals.

5. The apparatus of claim 4, wherein the center sub-band channel signals are produced by respectively summing the left sub-band signals and the right sub-band signals to produce a sum and amplifying the sum with a second of the gain values.

6. The apparatus of claim 5, wherein the left surround sub-band channel signals are produced by respectively determining a difference between the left sub-band signals and the right sub-band signals and amplifying the difference with a third of the gain values and a fourth of the gain values.

7. The apparatus of claim 6, wherein the right surround sub-band channel signal s are produced by respectively amplifying the difference with the third of the gain values and a fifth of the gain values.

8. The apparatus of claim 7, wherein, a first set of control parameters is used for producing the fourth and fifth of the gain values, and a second set of control parameters is used for producing the first, second, and third of the gain values.

9. The apparatus of claim 3, wherein the gain control unit comprises:

a threshold detection and gain adjustment calculation unit configured to determine the plurality of gain values for the sub-band channel signals;

at least one buffer configured to buffer the left and right sub-band signals;

at least one window configured to window the buffered left and right sub-band signals; and at least one accumulator configured to accumulate the windowed left and right sub-band signals and to produce a left accumulation value and a right accumulation value.

10. The apparatus of claim 9, wherein the gain control unit further comprises:

a first auto-correlator configured to auto-correlate a buffered and windowed sum of the left and right sub-band signals to produce a total correlation value; and a second auto-correlator configured to auto-correlate a buffered and windowed difference between the left and right sub-band signals to produce a differential correlation value.

11. A method, comprising:

splitting and filtering, with a band-splitting filter bank, a left input signal and a right input signal to produce a plurality of frequency sub-bands, each of the frequency sub-bands comprising a left sub-band signal and a right sub-band signal;

processing the left and right sub-band signals associated with each of the frequency sub-bands into a plurality of sub-band channel signals;

calculating a plurality of frequency sub-band specific gain values for each of the sub-band channel signals using predetermined windows, each frequency sub-band specific gain value for one of the sub-band channel signals adjusted between a maximum gain and an ideal gain based upon a presence of a dominant signal in the sub-band channel signals, wherein the plurality of sub-band channel signals comprises: a plurality of left sub-band channel signals, a plurality of right sub-band channel signals, a plurality of center sub-band channel signals, a plurality of left surround sub-band channel signals, and a plurality of right surround sub-band channel signals; and summing a corresponding plurality of sub-band channel signals for reproduction in a corresponding channel of a plurality of channels.

12. The method of claim 11, wherein processing the left and right sub-band signals comprises:

amplifying the left sub-band signal with a first gain value to produce the left sub-band channel signals; and amplifying the right sub-band signal with the first gain value to produce the right sub-band channel signals.

13. The method of claim 12, wherein processing the left and right sub-band signals further comprises:

summing the left sub-band signal and the right sub-band signal to produce a sum; and amplifying the sum with a second gain value to produce the center sub-band channel signals.

14. The method of claim 13, wherein processing the left and right sub-band signals further comprises:

determining a difference between the left sub-band signal and the right sub-band signal;

amplifying the difference with a third gain value and a fourth gain value to produce the left surround sub-band channel signals; and amplifying the difference with the third gain value and a fifth gain value to produce the right surround sub-band channel signals.

15. The method of claim 14, wherein only one of the first, second, and third gain values is incremented and all others of the first, second, and third gain values are decremented when only one of the sub-band channel signals associated with the first, second, and third gain values is dominant.

16. The method of claim 14, wherein each of the first, second, and third gain values is incremented or decremented towards a gain value when multiple ones of the sub-band channel signals associated with the first, second, and third gain values are dominant.

17. The method of claim 11, wherein processing the left and right sub-band signals comprises:

buffering, windowing, and accumulating the left and right sub-band signals to produce a left accumulation value and a right accumulation value; and buffering, windowing, and auto-correlating a sum of the left and right sub-band signals and a difference between the left and right sub-hand signals to produce a total correlation value and a differential correlation value.

18. A system, comprising:

a plurality of input channels configured to receive a left input signal and a right input signal;

a plurality of output channels configured to provide a plurality of output signals, the plurality of output signals comprising at least three output signals; and a plurality of synthesis structures at least one channel synthesis structure configured to:

split the left input signal and the right input signal into a plurality of frequency sub-bands, each of the frequency sub-bands comprising a left sub-band signal and a fight sub-band signal;

process the left and right sub-band signals associated with each of the frequency sub-bands into a plurality of sub-band channel signals, the plurality of sub-band channel signals comprising a plurality of left sub-band channel signals, a plurality of fight sub-band channel signals, a plurality of center sub-band channel signals, a plurality of left surround sub-band channel signals, and a plurality of right surround sub-band channel signals; wherein the plurality of synthesis structures comprise a gain control unit configured to determine a plurality of frequency sub-band specific gain values for each of the sub-band channel signals using predetermined windows, each frequency sub-band specific gain value for one of the sub-band channel signals adjusted between a maximum gain and an ideal gain based upon a presence of a dominant signal in the sub-band channel signals; and a mixer configured to sum a corresponding plurality of sub-band channel signals received from an output of the synthesis structures into a respective left channel, right channel, center channel, left surround channel, and right surround channel.

19. The system of claim 18, wherein, the left and right input signals are high pass filtered before processing by the synthesis structures, and the left and right input signals are summed and low pass filtered to produce a low frequency effects channel.

20. The system of claim 18, wherein the at least one channel synthesis structure further comprises:

a plurality of amplifiers configured to amplify signals using the gain values.

* * * * *